US005162767A

United States Patent [19]

Lee et al.

[11] Patent Number: 5,162,767

[45] Date of Patent: Nov. 10, 1992

[54] HIGH EFFICIENCY SOLENOID

[75] Inventors: David Lee, Sedona, Ariz.; Christopher K. Sortore, Redondo Beach, Calif.

[73] Assignee: Aura Systems, Inc., El Segundo, Calif.

[21] Appl. No.: 680,249

[22] Filed: Apr. 3, 1991

[51] Int. Cl.[5] ..... H01H 7/08

[52] U.S. Cl. ..... 335/255; 335/281

[58] Field of Search ..... 335/281, 258, 261, 255

[56] References Cited

U.S. PATENT DOCUMENTS

| | | | |
|---|---|---|---|
| 1,231,271 | 6/1917 | Kratz | 335/255 |
| 2,057,380 | 10/1936 | Keefe | 335/255 |
| 3,004,195 | 10/1961 | Peras | 335/261 |
| 4,716,393 | 12/1987 | Logie | 335/281 |

*Primary Examiner*—Harold Broome

*Attorney, Agent, or Firm*—Anthony T. Cascio; Lisa A. Clifford

[57] ABSTRACT

A high efficiency solenoid includes a magnetic material solenoid core, an electrical current conductive coil and a moveable magnetic plunger. The solenoid core has a first end portion, a first face disposed at the first end portion, a second end portion opposite the first end portion and a continuous channel disposed in the first face. The electrical current conductive coil disposed in the channel and arranged so that magnetic flux developed in response to a current in the coil forms a first magnetic pole on the first face interiorly of the channel and a second magnetic pole of opposite plurality on the first face exteriorly of the channel. The plunger has a surface and a facing coextensive relationship to the first face. The plunger is normally biased in a first position to space the surface from the first face to form a gap therebetween. There is no magnetic material which is received through a bore within the solenoid core. Therefore, the magnetic flux when present is bidirectional through the gap so that all magnetic flux exterior of the solenoid core develops a magnetic force substantial orthogonal to the surface to move the plunger to its second position, which is drawn towards the solenoid core reducing the gap.

9 Claims, 2 Drawing Sheets

HIGH EFFICIENCY SOLENOID

FIELD OF THE INVENTION

The present invention relates generally to electromagnetic solenoids and more particularly to a novel high efficiency solenoid with improved flux path characteristics.

BACKGROUND OF THE INVENTION

A typical electromagnetic solenoid has a coil embedded in a solenoid core with a plunger which is acted upon by the magnetic force developed by the coil. Usually, the solenoid core includes a coaxial bore therethrough. The plunger has a rod which is received in the bore in slidable engagement. The plunger usually has a flange upon which the magnetic force interacts. The core and the plunger are constructed from magnetic material such as soft magnetic iron.

When a current is induced within the coil, magnetic flux is developed through a flux path. The flux path is along the core radially outward of the coil, crosses the air gap between the end of the core and the flange of the plunger, traverses the flange radially inward to the plunger rod, which is received within the core, and finally, radially back to the core across another air gap within the bore between the plunger rod and the core.

Where the magnetic flux radially crosses the air gap in the coaxial bore between the plunger rod and the solenoid core, a significant amount of magnetic force is lost. Since the rod and the flange are being moved axially along the axis of the core, the radial flux does not contribute to any force to cause this movement. Therefore, only one half of the total available magnetic flux which is axial in the air gap between the end of the core and the flange, is being used to produce a magnetic force upon the flange. Since magnetic force is proportional to the square of flux within the air gap, the loss of one-half of the total available magnetic flux results in the loss of three-fourths of the available force which may be obtained from such flux.

It would therefore be highly desirable to construct a solenoid which utilizes all the flux crossing any air gap within the solenoid for developing useful force on the plunger.

SUMMARY OF THE INVENTION

Accordingly, it is an object of the present invention to overcome one or more of the limitations and disadvantages of the prior art enumerated hereinabove. It is another object of the present invention to provide a novel high efficiency solenoid which utilizes all magnetic flux crossing an air gap to develop a magnetic force.

According to the present invention, a high efficiency solenoid includes a magnetic material solenoid core, an electrical current conductive coil and a moveable magnetic plunger. The solenoid core has a first end portion, a first face disposed at the first end portion, a second end portion opposite the first end portion and a continuous channel disposed in the first face. The electrical current conductive coil is disposed in the channel and arranged so that magnetic flux developed in response to a current in the coil forms a first magnetic pole on the first face interiorly of the channel and a second magnetic pole of opposite polarity on the first face exteriorly of the channel. The plunger has a surface in a facing coextensive relationship to the first face. The plunger is normally biased in a first position to space the surface from the first face to form a gap therebetween. There is no magnetic material which is received through a bore within the solenoid core. Therefore, the magnetic flux when present is bidirectional through the gap so that all magnetic flux exterior of the solenoid core develops a magnetic force substantially orthogonal to the surface to move the plunger to its second position, wherein the plunger is drawn towards the solenoid core thereby reducing the gap.

It is therefore an important feature of the present invention that the magnetic flux within the air gap is bidirectional between the end portion of the core and the surface of the plunger. It is apparent that no magnetic flux is wasted through an air gap wherein such flux is not axial with the movement of the plunger.

These and other objects, advantages and features of the present invention will become readily apparent to those skilled in the art from the following description of an Exemplary Preferred Embodiment when read in conjunction with the attached Drawing and appended Claims.

DESCRIPTION OF AN EXEMPLARY PREFERRED EMBODIMENT

Figure 1:
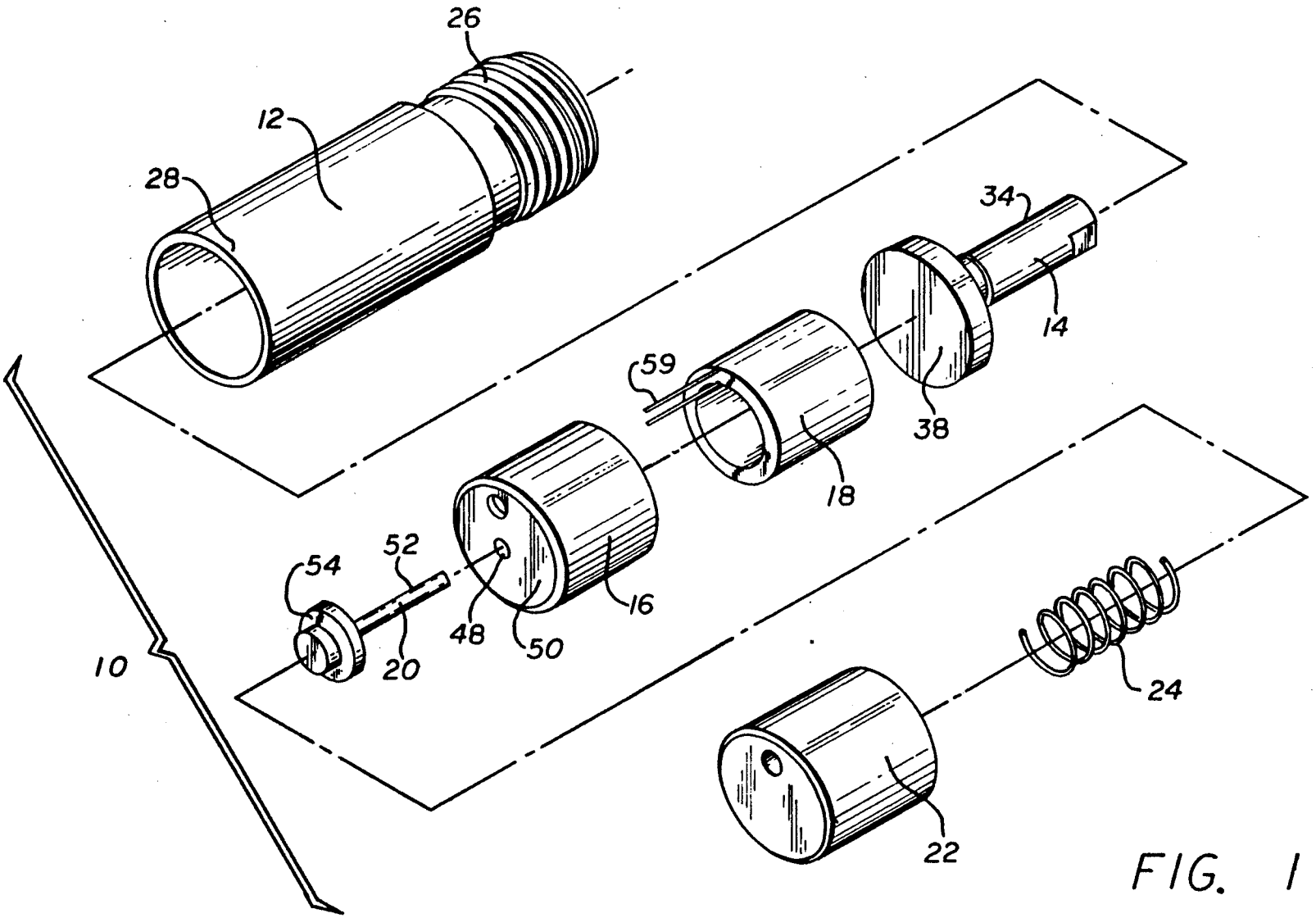
FIG. 1 is an exploded perspective view of a high efficiency solenoid constructed to the principles of the present invention.
Figure 2:
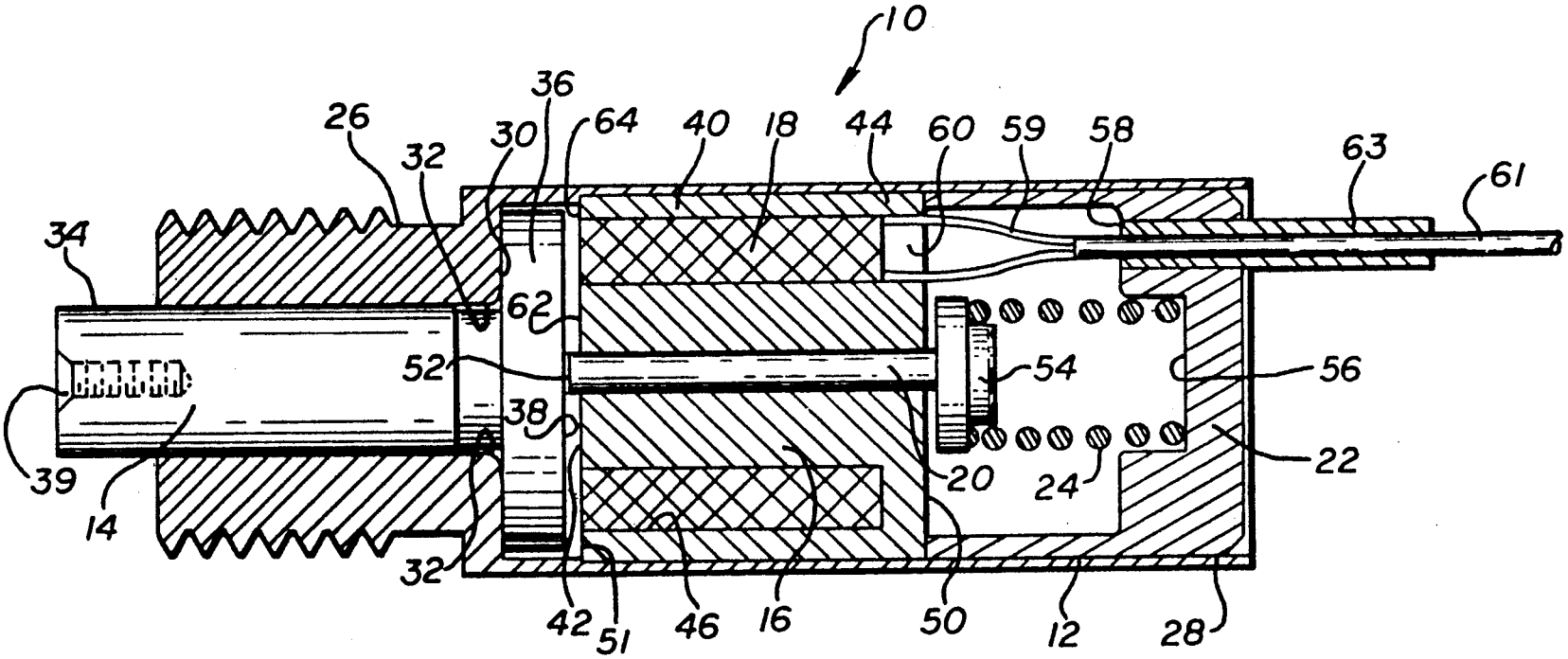
FIG. 2 is an assembled cross-sectional view of the solenoid of FIG. 1.

Referring now to FIG. 1 and FIG. 2, there is shown a high efficiency solenoid 10 constructed according to the principles of the present invention. The solenoid 10 includes a solenoid body 12, a plunger 14, a solenoid core 16, a coil 18, a pin 20, a cap 22 and a spring 24.

The solenoid body 12 is constructed from nonmagnetic material and is of a cylindrical hollow shape. More particularly, the solenoid body 12 has a first body end portion 26, a second body end portion 28, a body wall 30 and a coaxial bore 32. The body wall 30 is disposed at the first body end portion 26. The coaxial bore 32 is open at the body wall 30 and extends through the first body end portion 26. The first body end portion 26 may also be threaded, as seen in FIG. 2, for attachment of the solenoid 10 to a utilization device (not shown).

The plunger 14 is made is magnetic material. More particularly, the plunger 14 has an elongated rod 34 and a flange 36. The flange 36 further has a surface 38. The rod 34 is disposed through the coaxial bore 32 in axially slidable engagement. Furthermore, the rod 34 projects outwardly from the coaxial bore 32 to extend exteriorly of the solenoid body 12. The flange 36 is received within the solenoid body 12 near the first body end portion 26. The end of the rod 34 may have a threaded bore 39 to attach a device thereto.

The solenoid core is constructed of magnetic material and has a generally cylindrical shape. Furthermore, the solenoid core 16 is coaxially received within the solenoid body 12. More particularly, the solenoid core 16 has a first core end portion 40, a first face 42, a second core end portion 44, a coaxially annular channel 46, a coaxial bore 48 and a second face 50. The first core end portion 40 is disposed proximate to the first body end portion 26. The first face 42 is disposed at the first core end portion 40 in a facing relationship to the surface 38.

A lip 51 in the body 12 limits the depth of insertion of the core 16. The second core end portion 44 is at the opposite end of the solenoid core 16 from the first core end portion 40. The annular channel 46 is coaxially disposed in the first face 42. The coaxial bore 48 coaxially extends through the core 16. The second face 50 is disposed at the second core end portion 44.

The pin 20 is fabricated from nonmagnetic material. Furthermore, the pin 20 is disposed in axially slidable engagement within the coaxial bore 48 of the solenoid core 16. The pin 20 has a tip 52 and a head 54. The tip 52 projects outwardly of the first core end portion 40 and engages the surface 38 of the flange 36. The head 54 is disposed exteriorly of the second core end portion 44. Additionally, the head 54 is in a spaced apart relationship to the second face 50.

The cap 22 is constructed from nonmagnetic material and is of a cylindrical shape. The cap 22 is attached to the second body end portion 28 of the solenoid body 12 such as by being press fit within the second body end portion 28 as seen in FIG. 2. The cap 22 engages the second face 50 of the core 16 to firmly mount the core 16 within the body 12. More particularly, the cap has a cap wall 56 and an opening 58. The cap wall 56 is in a facing relationship to the body wall 30. The opening 58 is provided in the cap 22 so that electrical contact may be made to the coil 18. For example, as best seen in FIG. 2, a pair of wires 59 extends through the opening 58 to connect with the coil 18 through an additional opening 60 in the solenoid core 16. To mount the wires 59 in the opening 58, a shrink wrap tube 61 is disposed around the wires 59 with the shrink wrap tube 61 pressed into an insulative sheath 63. The sheath 63 is epoxy bonded to the cap 22 within the opening 58.

The plunger 14 is coaxially slidable between a normally biased first position and a second position. The spring 24 is disposed between the head 54 of the pin 20 and the cap wall 56 of the cap 22 to bias the plunger 14 in its first position. It is seen that the tip 52 pushes the surface 38 of the flange 36 to maintain the plunger 14 in the first position. While in the first position, the flange 38 abuts the body wall 30. Furthermore, while in the first position, the surface 38 and the first face 42 are in a spaced apart relationship to form a gap therebetween.

When the plunger 14 is in its second position, the surface 38 is moved adjacent the first face 42. The plunger 14 is moved into the second position by magnetic force as described hereinbelow.

The coil 18 is an electrically current conductive coil disposed within the channel 46. The channel 46 extends toward the second core end portion 44. The channel 46 forms a first pole piece 62 and a second pole piece 64. The first, pole piece 62 extends coextensively along the channel 46. Furthermore, the first pole piece 62 is radially inwardly axially disposed with respect to the channel 46. Similarly, the second pole piece 64 extends coextensively along the channel 46. However, the second pole piece 64 is radially outwardly axially disposed with respect to the channel 46.

The coil 18 is disposed in the channel 46 and arranged so that magnetic flux developed in response to a current in the coil 18 is continuous along a flux path in the first pole piece 62, the second pole piece 64 and the second core end portion 44. The current further develops a first magnetic pole on the first face 42 at the first pole piece 62 and a second magnetic pole of opposite polarity on the first face 42 at the second pole piece 64. The flux when developed by the current within the coil 18 is therefore bidirectional through the gap formed between the surface 38 and the first core end portion 40. However, because the pin 20 is fabricated from the nonmagnetic material, the flux will not travel down the pin 20 and therefore does not cross the radial air gap between the pin 20 and the core 16 in a direction parallel to the surface 38. Because the travel of flux radially across the radial air gap between the pin and core is eliminated, the previous loss of magnetic force in the radial air gap is also eliminated. Accordingly, all the magnetic flux exterior of the solenoid core 16 develops a magnetic force substantially orthogonal to the surface 38 to move the plunger 14 to its second position. When the plunger is in the second position, the flux path in continued radially through the flange 36.

Therefore, it is an important feature of the present invention wherein all the magnetic flux is used to exert force on the plunger 14. This feature is to be compared to the prior art where magnetic flux is wasted through an air gap which is usually normal to the direction of movement of the plunger 14 through a bearing surface of the solenoid. Accordingly, the solenoid 10 of the present invention is four times more efficient than the prior art solenoid.

This efficiency is seen from the formula:

$$f=(b_g^2 a_g)/(2\ \mu_o)$$

wherein f is the force of attraction between the plunger 14 and core 16, $b_g$ is the flux density in the air gap between the plunger and the core, $a_g$ is the surface area of the core poles 62, 64 facing the plunger 14, and $\mu_o$ is the magnetic permeability of air. It is seen that since twice the flux density in an air gap is used in the solenoid of the present invention, the magnetic force is accordingly four time greater than in the prior art solenoid.

The flux density, $b_g$, is designed to be equal to the saturation flux density of the magnetic material used to construct the plunger 14 and the core 16. For soft magnetic iron, the saturation flux density is 1.2–1.3 Tesla. The number of turns of the coil may then be determined by the relationship:

$$n=(2\ gb_g)/(\mu_o i)$$

wherein g is the air gap length between the plunger 14 and the core 16, i is the available current and $b_g$ and $\mu_o$ are defined above.

It is apparent that those skilled in the art may now make numerous uses of and departures of the novel high efficiency solenoid described hereinabove without departing from the inventive concepts disclosed herein. Accordingly, the present invention is to be defined solely by the scope of the following claims.

I claim:

1. A high efficiency solenoid comprising:

a magnetic material solenoid core having a first end portion, a first face disposed at said first end portion, a second end portion opposite said first end portion and a continuous channel disposed said first face;

an electrical current conductive coil disposed in said channel and arranged so that magnetic flux developed in response to a current in said coil forms a first magnetic pole on said first face interiorly of said channel and a second magnetic pole of opposite polarity on said first exteriorly of said channel;

a moveable magnetic material plunger having a flange with a flange surface and a rod extending from said flange, said surface being in a facing coextensive relationship to said first face, and said plunger being external to said core; and a nonmagnetic material pin, said pin being disposed within a bore defined in said core between said first end portion and said second end portion, said pin being disposed in slidable engagement with said bore, said pin having a tip projecting outwardly of said first end portion and in engagement with said flange surface; wherein said pin serves to normally bias said plunger in a first position to space said surface from said first face to form a gap therebetween, said magnetic flux when present being bidirectional through said gap so that all magnetic flux exterior of said solenoid core develops a magnetic force substantially orthogonal to said flange surface to move said plunger to a second position wherein said gap is decreased.

2. A solenoid as set forth in claim 1 further comprising:

a head attached to said pin and disposed exteriorly of said bore second end portion in a spaced relationship thereto; and a spring mounted to exert a spring force on said head to bias said flange surface in said first position.

3. A high efficiency solenoid comprising:

a generally cylindrical magnetic material solenoid core having a first end portion, a first face disposed at aid first end portion, a second end portion and an annular channel coaxially disposed in said first face extending toward said second end portion to form a first pole piece radially inward and axially coextensive along said channel and a second pole piece radially outward and axially coextensive along said channel;

an electrical current conductive coil disposed in said channel and arranged so that magnetic flux develop in response to a current in said coil is continuous along a flux path in said first pole piece, said second pole piece and said second end portion and further develops a first magnetic pole on said first face at said first pole piece and a second magnetic pole of opposite polarity on said first face at said second pole piece;

a moveable magnetic material plunger having a flange including a flange surface, and a rod extending from said flange, said flange surface being in a facing coextensive relationship to said first face, and said plunger being external to said core; and a nonmagnetic material pin, said pin being disposed in a bore defined within said core between said first end portion and said second end portion, said pin being disposed in slidable engagement within said bore, said pin having a tip projecting outwardly of first end portion and in engagement with said flange surface; wherein said pin serves to normally bias said plunger in a first position to space said flange surface from said first face to form a gap therebetween, said magnetic flux when present being bidirectional through said gap so that all magnetic flux exterior of said solenoid core develops a magnetic force substantially orthogonal to said surface to move said plunger to a second position wherein said gap is decreased.

4. A solenoid as set forth in claim 3 further comprising:

a head mounted to said pin and disposed exteriorly of said bore second end portion in a spaced relationship thereto; and a spring mounted to exert a spring force on said head to bias said flange surface in said first position.

5. A solenoid as set forth in claim 3 further comprising a generally hollow cylindrical solenoid body in which said core is mounted, said plunger being mounted in said body in coaxially slidable engagement.

6. A high efficiency solenoid comprising:

a cylindrical hollow non-magnetic material solenoid body having a first body end portion, a second body end portion, a body wall at said first end portion and a first coaxial bore extending through said wall;

a magnetic material plunger having an elongated rod and a flange, said flange having a surface, said rod being disposed through said bore in axially slidable engagement and extending exteriorly of said body, said flange being received within said body;

a generally cylindrical magnetic material solenoid core coaxially received within said body, said core having a first core end portion disposed proximate to said first body end portion, a first face disposed at said first core end portion in a facing relationship to said surface, a second core end portion, a coaxial annular channel disposed in said first face, a second coaxial bore extending through said core and a second face disposed at said second core end portion, said plunger being coaxially slidable between a normally biased first position wherein said flange abuts said wall with said surface and said first face being spaced apart to form a gap therebetween and a second position wherein said surface is moved adjacent said first face, said channel extending toward said second core end portion to form a first pole piece radially inward and axially coextensive along said channel and a second pole radially inward and axially coextensive along said channel;

an electrical current conductive coil disposed in said channel and arranged so that magnetic flux developed in response to a current in said coil is continuous along a flux path in said first pole piece, said second pole piece and said second core end portion end develops a first magnetic pole on said first face at said first pole piece and a second magnetic pole of opposite polarity on said first face at said second pole piece, said flux when present being bidirectional through said gap so that all magnetic flux exterior of said solenoid core develops a magnetic force substantially orthogonal to said surface to move said plunger to said second position wherein said flux path is radial through said flange;

a nonmagnetic material pin disposed in axially slidable engagement within said second bore of said core, said pin having a tip projecting outwardly of said first core end portion and in engagement with said surface and a head disposed exteriorly of said second core end portion in a spaced relationship to said second face;

a nonmagnetic material cylindrical cap attached to said second body end portion, said cap having a cap wall in a facing relationship to said body wall, said cap having an opening through which electrical contact may be made to said coil; and a spring disposed between said head and said cap wall to bias said flange in said first position.

7. A solenoid as set forth in claim 6 wherein each of said cap and said core have an opening therethrough to receive a pair of wires to connect electrically to said coil to make external electrical connection thereto.

8. A solenoid as set forth in claim 6 wherein said first body end portion is threaded to attach to a utilization device.

9. A solenoid as set forth in claim 6 wherein said rod has a threaded hose to attach a utilization device thereto.

* * * * *